United States Patent [19]

Josefek et al.

[11] Patent Number: 5,033,250

[45] Date of Patent: Jul. 23, 1991

[54] GUM STICK WRAPPING MACHINE

[75] Inventors: Robert A. Josefek, Springfield; Paul J. La Fleur, Jr., Wilbraham, both of Mass.

[73] Assignee: Package Machinery Company, Stafford Springs, Conn.

[21] Appl. No.: 565,798

[22] Filed: Aug. 10, 1990

[51] Int. Cl.[5] ..... B65B 57/04

[52] U.S. Cl. ..... 53/51; 53/64; 53/176; 53/234; 53/389.1

[58] Field of Search ..... 53/51, 64, 176, 225, 53/228, 234, 389

[56] References Cited

U.S. PATENT DOCUMENTS

| | | | |
|---|---|---|---|
| 1,109,461 | 9/1914 | Price | 53/176 X |
| 1,572,256 | 2/1926 | Van Zuren | 53/176 |
| 4,070,851 | 1/1978 | Schoppee | 53/228 |
| 4,073,123 | 2/1978 | Schoppee | 53/234 |
| 4,128,985 | 12/1978 | Simmons | 53/64 X |
| 9,006,577 | 2/1977 | Schoppee | 53/176 X |

*Primary Examiner*—John Sipos

*Attorney, Agent, or Firm*—McCormick, Paulding & Huber

[57] ABSTRACT

A gum stick wrapping machine with gum stick wrapper storage and feed means advancing wrapper blanks in strip form, a wrapper mechanism assembles conveyor advanced gum sticks and wrappers with the latter enveloping the former. Band storage and feed means advance bands in strip form and a wrapper mechanism folds the same about the sticks of gum. A stacker provides stacks of wrapped and banded sticks and a package wrapper mechanism folds the wrappers about the stacks. The package wrappers are also stored in end-to-end elongated strip form. Band feed rolls and package wrapper feed rolls are driven by associated discrete servo motors in slave-master relationship with a main servo motor. Computer control means regulates motor speed ratios and provides for correction of errors in band or package wrapper length and/or band or package wrapper registration. Photoelectric eyes read registration marks on band and wrapper strips and advise the computer control means of errors to be corrected by speed adjustment of the band and/or package wrapper servo motor. Errors are corrected prior to completion of the next succeeding cycle of machine operation and on the occurrence of a pre-determined number of discrete cyclical speed corrections in the same direction, a permanent correction is effected in motor speed ratios.

22 Claims, 2 Drawing Sheets

GUM STICK WRAPPING MACHINE

BACKGROUND OF THE INVENTION

This invention relates in general to gum stick wrapping machines and, more particularly, to an improved high speed wrapping machine which includes a novel drive means comprising a number of interrelated servo motors and an associated computer control means therefor.

Gum stick wrapping machines of the general type under consideration are shown and described in the following patents, incorporated herein by reference:

U.S. Pat. No. 3099375 to Schoppee et al. issued July 30, 1963..

U.S. Pat. No. 4004797 to Schoppee, issued Jan. 25, 1977.

U.S. Pat. No. 4006577 to Schoppee, issued Feb. 8, 1977.

U.S. Pat. No. 4056199 to Schoppee, issued Nov. 1, 1977.

U.S. Pat. No. 4070851 to Schoppee, issued Jan. 31, 1978.

Gum wrapping machines of the type referred to in the aforesaid patents have been generally satisfactory but in recent years have been found somewhat lacking in speed of operation.

It is the general object of the present invention to provide an improved gum stick wrapping machine wherein efficient high speed operation is provided for, and wherein an improved drive means is provided for the implementation and precise control of such operation.

SUMMARY OF THE INVENTION

In accordance with the present invention and in fulfillment of the aforesaid object, a gum stick wrapping machine includes conveyor means for successively advancing sticks of gum seriatim in side-by-side relationship. A stick wrapper storage and feed means stores and successively advances gum stick wrapper blanks in integral end-to-end elongated strip form, sometimes referred to in the art as a "web" or "film". A single stick wrapper mechanism which includes a first rotary folder successively receives unwrapped sticks of gum from the conveyor together with complementary wrapper blanks severed from a leading end portion of the elongated wrapper strip. The gum sticks and wrapper blanks are successively assembled by the wrapper mechanism with the latter enveloping the former. Bands for folded assembly about the wrapped sticks are also stored and fed in the form of band blanks in integral end-to-end elongated "web", "film" or strip form. A band wrapper mechanism which includes a second rotary folder successively receives wrapped sticks of gum from the stick wrapper mechanism together with complementary band blanks severed from a leading end portion of the elongated band strip. The wrapped gum sticks and band blanks are successively assembled by the band wrapper mechanisms with the latter folded about the former.

In accordance with the presently prepared practice, discrete servo motors are provided for the main drive of the machine and for the band feed means. A computer control means for the servo motors includes a control panel and the main and band servo motors are normally operated by the control means in a master-slave mode. The band servo motor is, however, independently operable and controllable by the computer means for minor speed adjustment. Thus, the computer control means including the control panel is adapted for the manual selection and establishment of master-slave speed ratios between the main and band servo motors. Further, the computer control means and the servo motors are adapted for subsequent speed adjustment whereby to effect corrections in band length and/or position.

In addition to the foregoing, and as is well known in the art, registration marks are sometimes provided on the elongated band strip so as to provide for the accurate registration of severed band blanks about the wrapped gum sticks. In this mode of operation, a means is provided for sensing the positions of the registration marks and for delivering corresponding signals to the computer control means. The computer control means operates in conjunction with the band servo motor to adjust the speed of the latter independently of main motor speed and thereby to correct band-gum stick registration errors detected by the sensing means. High speed error correction is achieved with errors being detected on a cyclical basis and with each correction being achieved prior to the completion of the next succeeding cycle of machine operation. Moreover, the computer control means and the band servo motor cooperate to effect a permanent correction in the main-band servo motor speed ratio on the occurrence of a pre-determined number of discrete cyclical speed corrections in the same direction. Preferably, a photoelectric sensing means is provided for the registration marks, with the latter taking the form of repetitive visible indicia spaced along the band strip.

The gum stick wrapping machine of the present invention preferably also includes a stacker mechanism for successively receiving wrapped and banded gum sticks and arranging the same in stacks of pre-selected numbers of sticks. A package wrapper storage and feed means successively advances gum package wrapper blanks in integral end-to-end elongated "web", "film" or strip form. A package wrapper mechanism includes at least one rotary package folder for successively receiving stacks of gum sticks together with complementary package wrapper blanks severed from a leading end portion of the package wrapper strip. The stacks of gum sticks and wrapper blanks are successively assembled by the wrapper mechanism with the latter folded about and enveloping the former.

When the machine includes a stacker mechanism, package wrapper storage and feed means, and a wrapper mechanism, a separate package wrapper servo motor is preferably provided and is arranged in slave-master relationship with the aforementioned main servo motor under the control of the computer control means. The computer control means is adapted for the manual selection and establishment of slave-master speed ratios between the motors and the control means and servo motors are further adapted for subsequent speed adjustment to effect correction of package wrapper length and/or position.

When the elongated package wrapper strip is provided with repetitive registration marks along its length, a sensing means is also provided for response to the positions of the registration marks and for the introduction of corresponding signals to the computer control means. The computer control means thereupon operates in conjunction with the package wrapper servo motor to adjust its speed independently and thereby to correct wrapper-stack registration errors detected by the sensing means. As in the case of the aforementioned band registration mark and sensing means, the computer control means and package wrapper servo motor correct registration errors on a cyclical basis with each correction being achieved prior to the completion of the next succeeding cycle of machine operation. Further, the computer control means and the package wrapper servo motor cooperate to effect a permanent correction in the main-package wrapper motor speed ratio in response to a pre-determined number of discrete cyclical speed corrections in the same direction. Photoelectric sensing means is again preferred with the registration marks taking the form of repetitive visible indicia spaced along the length of the package wrapper strip.

As will be apparent from the foregoing, the main servo motor is arranged to drive substantially all operating machine components under the direction and control of the computer control means and associated control panel means. One or more additional servo motors may be provided and, preferably, separate servo motors are provided for both the band feed means and the package wrapper feed means as set forth above.

DETAILED DESCRIPTION OF THE PREFERRED EMBODIMENT

Figure 1:
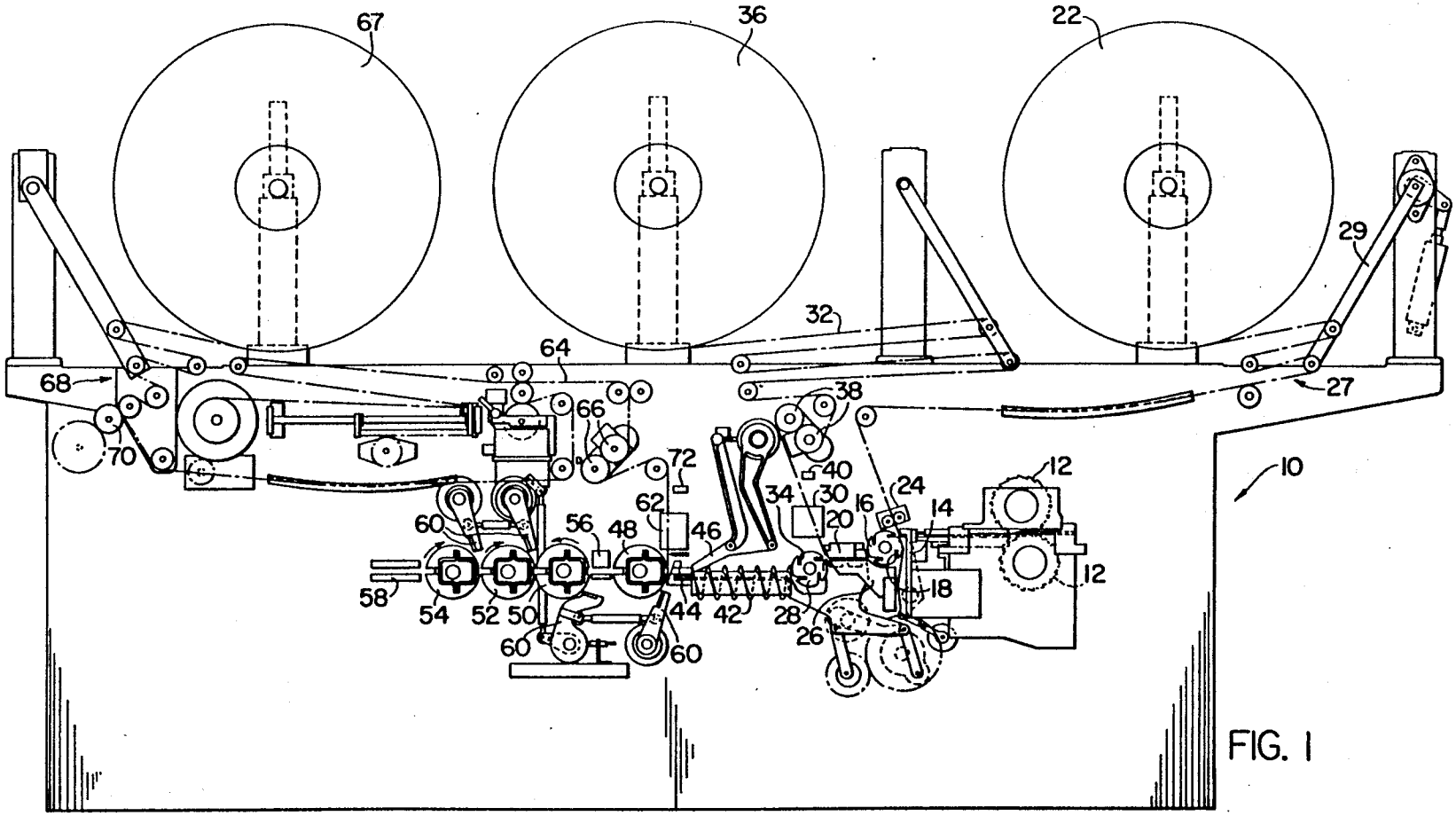
FIG. 1 is a side elevational view in schematic form of a gum stick wrapping machine constructed in accordance with the present invention.

Referring particularly to FIG. 1, a gum stick wrapper machine indicated generally at 10 comprises breaker wheels 12, 12 which break individual gum sticks from a scored slab of sticks in progression from right to left therethrough. The individual gum sticks are then fed leftwardly by conveyor means including a pusher element 14 for delivery to a first rotary folder 16. The rotary folder or "tumble box" 16 rotates in a counterclockwise direction receiving individual gum sticks in its slots 18, 18 with individual gum stick wrapper blanks partially folded thereabout. More particularly, a gum stick wrapper blank severed from a leading end portion of a strip of blanks is positioned adjacent to and across the mouth of a slot 18 and as the pusher 14 urges a gum stick into the slot, the wrapper is partially folded thereabout. In subsequent rotation of the folder 16 the folder wheel cooperates with adjacent plow mechanism and an end folder 20 to complete the folding operation of the wrapper about the gum stick and to provide for assembly of the gum stick and wrapper with the latter enveloping the former.

Individual stick wrappers are provided in blank form in integral end-to-end elongated "web", "film" or strip form and are stored on a large storage reel 22. Feed means for the strip associated with cutter or knife 24 advance the strip drawing the same through "festoons" of rolls indicated generally at 27 and having an associated tension arm 29. As will be apparent, the leading end wrapper blanks severed by the knife or cutter 24 are delivered to the rotary folder 16 in timed relationship with the delivery of the gum sticks by the pusher 14.

A further element in a conveyor means for the machine comprises "a walking beam" mechanism 26 which removes the wrapped gum sticks from the folder 16 and end folder 20 for delivery to a next succeeding station in the machine. A second rotary folder 28 thereat forms a part of a band wrapper mechanism and has an associated knife or cutter mechanism 30 which severs leading end portions of a band strip 32. As the wrapped gum sticks are introduced to slots 34 in the rotary folder 28 they engage and partially fold the severed band blanks about themselves. Thus, subsequent counterclockwise rotation of the folder, with associated folding mechanism, results in a band folded completely about the wrapped stick of gum.

As in the case of the stick wrapper blanks, the band blanks are stored on reel 36 in integral end-to-end "web", "film", or strip form. Thus, the band strip 32 is drawn from the reel 36 by feed means in the form of feed rolls 38, 38. The band blanks stored on the reel 36 in the form of strip 32 may also include registration marks as mentioned above and a sensing means in the form of a photo cell or photo electric sensor is preferably provided at 40 so as to respond to the position of each registration mark on the band strip 32 as it passes thereby.

A further part of the conveyor means of the machine takes the form of a horizontal screw type conveyor at 42 which receives wrapped and banded sticks from the rotary folder 28 and transports the same leftwardly in the machine to a stacker mechanism. The latter preferably includes a vertical screw type conveyor 44 similar to the conveyor 42 and operates to receive and stack individual sticks of gum in stacks of pre-selected numbers of sticks. For example, stacks of 5, 18 sticks etc. may be provided. The stacks of gum sticks are then urged leftwardly by a stack pusher 46 into a further rotary package folder or "tumble box" 48 in a series of four such folders or tumble boxes including the boxes 50, 52 and 54. The rotary folders or tumble boxes 48–54 have associated pusher-ejector mechanisms at 60, 60 for rotating the same and for ejecting the stacks and associated package wrappers therefrom. In right to left progression through the folders or tumble boxes 48–54 the stacks of gum sticks are enveloped within package wrappers which are also conventionally heat sealed. A long seam heat sealer is provided at 56 for the longitudinal seam along the length of a gum stick package and additional heating and sealing means are provided at 58 for sealing at the folded over end portions of the packages. The folding and sealing operations as well as the mechanism for achieving the same are for the most part conventional and reference may be had to the aforementioned patents for a more detailed discussion and illustration thereof. Similar reference may also be had to the patents for other machine operating elements.

On the entry of the initial stack to the first rotary folder or tumble box 48 a package wrapper blank is held adjacent the stack so as to be partially folded thereabout during introduction of the stack to the rotary folder. A knife or cutter mechanism 62 severs a leading end package wrapper blank from a strip 64 advanced thereto by feed rolls 66, 66. The package wrapper strip is stored on a reel 67 and is drawn therefrom through a festoon arrangement 68 for delivery to the feed rolls 66 with a stencil optionally applied thereto. That is, a stencil applicator is illustrated at 70 for the optional application of a stencil to the strip 64 prior to its introduction to the feed rolls 66, 66.

As indicated above, the package wrapper strip may also include registration marks as in the case of the band strip 32. Accordingly, a sensing means 72 is provided for detecting the positions of registration marks on the strip in relation to the cut-off mechanism 62 and/or other machine elements and may comprise a photo electric eye or photo cell 72.

Figure 2:
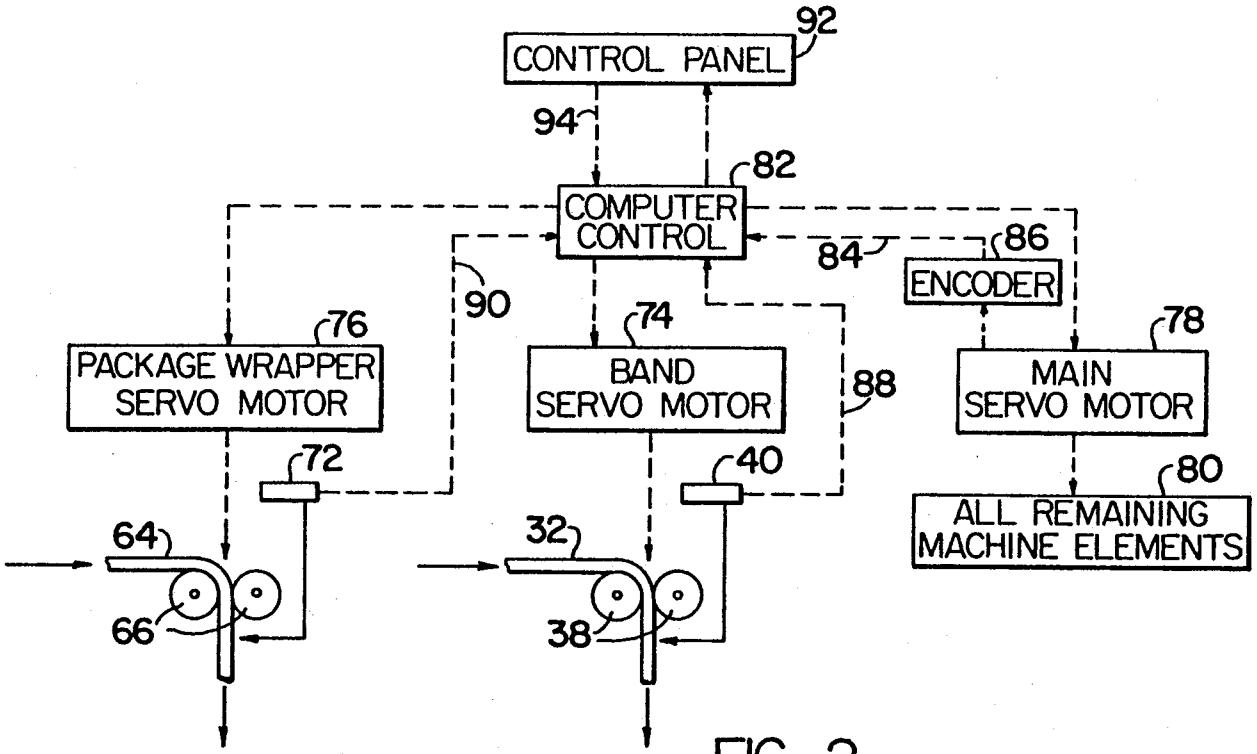
FIG. 2 is a schematic illustration largely in block diagram form illustrating the servo motor and control system of the present invention.

Referring now particularly to FIG. 2, the band feed rolls 38, 38 are shown schematically in association with the band strip 32 and the package wrapper feed rolls 66, 66 are similarly illustrated in association with the package wrapper strip 64. The respective photo-cells 40, 72 are illustrated in operative relationship with the bands 32 and 64 and separate servo motors 74 and 76 are shown operatively associated respectively with the feed rolls 38, 38 and 66, 66. A main servo motor 78 drives all remaining operating elements or components in the wrapping machine as indicated at 80. Computer control 82 is provided with a signal at 84 from an encoder 86 which responds to the speed of the main servo motor 78. Further, signal 88 is provided to the computer control from the photo cell 40 associated with the band strip 32 and photo cell 72 delivers signal 90 to the computer control. Signals from control panel 92 are also introduced to the computer control at 94 and the computer in turn controls all three servo motors in a conventional manner.

As mentioned above, the length of a band or package wrapper blank can be pre-selected and established by an appropriate setting of the master-slave speed ratio at the control panel. More particularly, the ratio between the main servo motor and the band servo motor may be established at the control panel and will usually fall in the range of a 2 to 1 ratio, the precise speed ratio being determined by the desired length of the band. The band servo motor draws one band blank through operation of the feed rolls 38, 38 for each revolution of the main servo motor, such relationship holding irrespective of the speed of the main servo motor, its rate of acceleration or deceleration. The speed ratio and band blank length may also be trimmed through the computer control while the machine is in operation.

When the elongated band strip is provided with spaced repetitive marks along its length for the accurate registration of severed band blanks about wrapped gum sticks, the photo cell 40 delivers corresponding signals through the computer control 82 and the computer control and band servo motor 74 operate to adjust motor speed and feed roll speed whereby to correct bandgum stick registration errors detected by the photo cell 40. The computer control means and band servo motor have fast response characteristics and cooperate to correct band-gum stick registration errors detected by the sensing means on a cyclical basis. That is, errors are detected during one cycle of machine operation and corrections are made prior to the completion of the next succeeding cycle of machine operation. Still further, the computer control means causes the band servo motor to effect a permanent correction to the main-band servo motors speed ratio on the occurrence of a pre-determined number of discrete cyclical speed corrections in the same direction.

The operation of the computer control 82 and the package wrapper servo motor 76, the feed roll 66, 66 and the photo cell 72 are substantially identical with the aforedescribed operation of similar elements in the computer controlband servo motor system. The package wrapper servo motor, however, will normally operate at approximately one tenth the speed of the main servo motor, the exact speed being determined by the length of wrapper blank which is entered into the computer control 82 at the control panel 92. As in the case of the band servo motor, the package wrapper servo motor 76 draws the wrapper from its reel irrespective of the main servo motor speed or its rate of acceleration or deceleration.

From the foregoing, it will be apparent that an improved gum stick wrapper machine has been provided with particular improvement in the machine drive means. That is, high speed operation is achieved with separate servo motors for band and/or package wrapper strips under the common control of a computer control means and a master or main servo motor. Extremely accurate registration of bands about individual wrapped gum sticks and package wrappers about stacks of gum sticks is thus achieved at rates of machine operation as high as 2000 gum sticks per minute.

We claim:

1. A gum stick wrapping machine comprising a gum stick conveyor for successively advancing sticks of gum seriatim in side-by-side relationship, stick wrapper storage and feed means for storing and successively advancing gum stick wrapper blanks in integral end-to-end elongated strip form, a single stick wrapper mechanism including a first rotary folder for successively receiving unwrapped sticks of gum from the conveyor together with complementary wrapper blanks severed from a leading end portion of the elongated wrapper strip, the gum sticks and wrapper blanks being successively assembled by the wrapper mechanism with the latter enveloping the former, band storage and feed means for storing and successively advancing gum stick band blanks in integral end-to-end elongated strip form, a band wrapper mechanism including a second rotary folder for successively receiving wrapped sticks of gum from said stick wrapper mechanism together with complementary band blanks severed from a leading end portion of the elongated band strip, the wrapped gum sticks and band blanks being successively assembled by the band wrapper mechanism with the latter folded about the former, main and band servo motors, and computer control means therefor, said motors being in master-slave relationship but with the band servo motor independently operable and controllable for minor speed corrections, said main servo motor being connected in driving relationship with the conveyor, the single stick wrapper feed means, the stick wrapper mechanism, and the band wrapper mechanism, said band servo motor being connected in driving relationship with the feed means for the elongated band strip, and said computer control means including control panel means adapted for the selection and establishment of master-slave speed ratios between the motors, and the computer control means and servo motors being further adapted for subsequent speed adjustment to effect correction of band length.

2. A gum stick wrapping machine as set forth in claim 1 wherein a speed and position means is provided for sensing main servo motor speed and position and for introducing a corresponding signal to said computer control means for use as a reference.

3. A gum stick wrapping machine as set forth in claim 1 wherein said band strip feed means includes a pair of opposed band strip feed rollers at least one of which is driven by said band servo motor.

4. A gum stick wrapping machine as set forth in claim 1 wherein the main and band servo motors are caused to operate at a reduced speed ratio by said computer control means.

5. A gum stick wrapping machine as set forth in claim 1 wherein the elongated band strip is provided with spaced repetitive marks along its length for the accurate registration of severed band blanks about wrapped gum sticks, wherein means is provided for sensing the positions of said registration marks and for delivering corresponding signals to the computer control means, and wherein said computer control means operates to cause the band servo motor to adjust its speed and thereby correct band-gum stick registration errors detected by said sensing means.

6. A gum stick wrapping machine as set forth in claim 5 wherein the computer control means and band servo motor cooperate to correct band-gum stick registration errors detected by said sensing means on a cyclical basis with each correction being achieved prior to the completion of the next succeeding cycle of machine operation.

7. A gum stick wrapping machine as set forth in claim 6 wherein the computer control means and band servo motor cooperate to effect a permanent correction in the main-band servo motor speed ratio in response to a pre-determined number of discrete cyclical speed corrections in the same direction.

8. A gum stick wrapping machine as set forth in claim 5 wherein photo-electric means is provided for sensing registration marks, and wherein the registration marks take the form of repetitive visible indicia spaced along the band strip.

9. A gum stick wrapping machine as set forth in claim 1 including a stacker mechanism for successively accepting wrapped and banded gum sticks and arranging the same in stacks of pre-selected numbers of sticks, package wrapper storage and feed means for storing and successively advancing gum package wrapper blanks in integral end-to-end elongated strip form, a package wrapper mechanism including at least one rotary package folder for successively receiving stacks of gum sticks together with complementary package wrapper blanks severed from a leading end portion of the package wrapper strip, the stacks of gum sticks and wrapper blanks being successively assembled by the wrapper mechanism with the latter folded about the former, and a package wrapper servo motor in slave-master relationship with the main servo motor and connected with the computer control means, the computer control means including said control panel means and package wrapper servo motor being adapted for the selection and establishment of slave-master speed ratios between the motors, and the computer control means and servo motors being further adapted for subsequent speed adjustment to effect correction of package wrapper length.

10. A gum stick wrapping machine as set forth in claim 9 wherein the computer control means causes the main and package wrapper servo motors to operate at approximately a ten-to-one speed ratio.

11. A gum stick wrapping machine as set forth in claim 9 wherein the elongated package wrapper strip is provided with repetitive marks along its length for the accurate registration of severed wrapper blanks about stacks of gum sticks, wherein means is provided for sensing the positions of said registration marks and for delivering corresponding signals to the computer control means, and wherein said computer control means operates to cause the package wrapper servo motor to adjust its speed and thereby correct wrapper-stack registration errors detected by said sensing means.

12. A gum stick wrapping machine as set forth in claim 11 wherein the computer control means and package wrapper servo motor cooperate to correct package wrapper-stack registration errors detected by said sensing means on a cyclical basis with each correction being achieved prior to the completion of the next succeeding cycle of machine operation.

13. A gum stick wrapping machine as set forth in claim 12 wherein the computer control means and the package wrapper servo motor cooperate to effect a permanent correction in the main—package wrapper motor speed ratio in response to a pre-determined number of discrete cyclical speed corrections in the same direction.

14. A gum stick wrapping machine as set forth in claim 11 wherein photo electric means is provided for sensing registration marks, and wherein the registration marks take the form of repetitive visible indicia spaced along the package wrapper strip.

15. A gum stick wrapping machine comprising a gum stick conveyor for successively advancing sticks of gum in side-by-side relationship, stick wrapper storage and feed means for storing and successively advancing gum stick wrapper blanks in integral end-to-end elongated strip form, a single stick wrapper mechanism including a first rotary folder for successively receiving unwrapped sticks of gum from the conveyor together with wrapper blanks severed from a leading end portion of the elongated wrapper strip, the gum sticks and wrapper blanks being successively assembled by the wrapper mechanism with the latter enveloping the former, band storage and feed means for storing and successively advancing individual gum stick band blanks in integral end-to-end elongated strip from, a band wrapper mechanism including a second rotary folder for successively receiving wrapped sticks of gum from said stick wrapper mechanism together with band blanks severed from a leading end portion of the elongated band strip, the wrapped gum sticks and band blanks being successively assembled by the band wrapper mechanism with the latter folded about the former, a stacker mechanism for successively accepting wrapped and banded gum sticks and arranging the same in stacks of pre-determined numbers of sticks, a package wrapper storage and feed means for storing and successively advancing package wrapper blanks in integral end-to-end elongated strip form, a package wrapper mechanism including at least one rotary package folder for successively receiving stacks of gum sticks together with package wrapper blanks severed from a leading end portion of the elongated package wrapper strip, the stacks of gum sticks and wrappers being successively assembled by the wrapper mechanism with the latter folded about the former, drive means for the wrapping machine including a main servo motor and a package wrapper servo motor in master-slave relationship but with the package wrapper servo motor independentaly operable and controllable for minor speed corrections, said main servo motor being connected in driving relationship with the conveyor, the single stick wrapper feed means, the stick wrapper mechanism, and the package wrapper mechanism, said package wrapper servo motor being connected in driving relationship with the feed means for the package wrapper, and computer control means including control panel means for the drive means in operative relationship with the main and wrapper servo motors for the manual selection and establishment of master-slave speed ratios therebetween, and the computer control means and servo motors being further adapted for subsequent speed adjustment to effect correction of package wrapper length.

16. A gum stick wrapping machine as set forth in claim 15 wherein a speed and position means is provided for sensing main servo motor speed and position and for introducing a corresponding signal to said computer control means for use as a reference.

17. A gum stick wrapping machine as set forth in claim 15 wherein said package wrapper strip feed means includes a pair of opposed wrapper strip feed rollers at least one of which is driven by said package wrapper servo motor.

18. A gum stick wrapping machine as set forth in claim 15 wherein the main and package wrapper servo motors are caused to operate at approximately a 10 to 1 speed ratio.

19. A gum stick wrapping machine as set forth in claim 15 wherein the elongated package wrapper strip is provided with repetitive marks along its length for the accurate registration of severed wrapper blanks about stacks of gum sticks, wherein means is provided for sensing the positions of said registration marks and for delivering corresponding signals to the computer control means, and wherein said computer control means operates to cause the package wrapper servo motor to adjust its speed and thereby correct wrapper-stack registration errors detected by the sensing means.

20. A gum stick wrapping machine as set forth in claim 19 wherein the computer control means and package wrapper servo motor cooperate to correct package wrapper—stack registration errors detected by said sensing means on a cyclical basis with each correction being achieved prior to the completion of the next succeeding cycle of machine operation.

21. A gum stick wrapping machine as set forth in claim 20 wherein the computer control means and the package wrapper servo motor cooperate to effect a permanent correction in the main—package wrapper motor speed ratio in response to a predetermined number of discrete cyclical speed corrections in the same direction.

22. A gum stick wrapping machine as set forth in claim 21 wherein photo electric means is provided for sensing registration marks, and wherein the registration marks take the form of repetitive visible indicia spaced along the package wrapper strip.

* * * * *